US006641245B1

(12) United States Patent
Kelly et al.

(10) Patent No.: US 6,641,245 B1
(45) Date of Patent: Nov. 4, 2003

(54) PRINTING APPARATUS WITH ADAPTIVE SERVICING SLED CONTROL AND METHOD

(75) Inventors: Kieran B Kelly, Vancouver, WA (US); Philip Stallbaumer, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 12 days.

(21) Appl. No.: 10/155,457

(22) Filed: May 23, 2002

(51) Int. Cl.[7] ..... B41J 29/393; B41J 2/165
(52) U.S. Cl. ..... 347/19; 347/23; 347/33
(58) Field of Search ..... 347/19, 23, 22, 347/33, 34, 29

(56) References Cited

U.S. PATENT DOCUMENTS 5,644,347 A * 7/1997 Schwiebert et al. ..... 347/33
5,847,727 A 12/1998 VanLiew et al.
6,000,780 A 12/1999 Schwiebert et al.
6,135,585 A 10/2000 Johnson et al.
6,155,667 A 12/2000 Eckard et al.
6,280,015 B1 8/2001 Nguyen et al.
6,511,150 B1 * 1/2003 Yoda et al. ..... 347/23
6,550,887 B2 * 4/2003 Therien et al. ..... 347/22

* cited by examiner

*Primary Examiner*—Stephen D. Meier
*Assistant Examiner*—An H. Do

(57) ABSTRACT

An inkjet printer having functionality to adaptively control an amount of force applied to a servicing sled used to clean an inkjet printhead. In selecting a run force to be applied to the servicing sled, a test force is applied to the servicing sled to determine if the servicing sled will move a predetermined distance under the test force.

25 Claims, 2 Drawing Sheets

PRINTING APPARATUS WITH ADAPTIVE SERVICING SLED CONTROL AND METHOD

TECHNICAL FIELD

The present invention is generally related to the field of printers and, more particularly, is related to a printing apparatus having a servicing sled that is adaptively controlled.

BACKGROUND OF THE INVENTION

Inkjet printers are often used to print documents and images on a print medium. The print medium can include various types of media, such as paper, photographic print media, labels and so forth.

A conventional inkjet printer includes a movable inkjet printhead mounted on a print cartridge. A carriage assembly moves the print cartridge, and inkjet printhead, laterally over the print medium in successive passes. The print medium is advanced in a direction perpendicular to the motion of the printhead by a drive assembly so that the printhead can progressively lay down ink droplets corresponding to the desired pattern being printed.

The printhead has an array of nozzles, which are typically grouped into pens. Each nozzle generates ink droplets as the printhead moves over the print medium to produce the desired pattern on the print medium. Typically, each nozzle is formed by a nozzle chamber, a firing mechanism, and an orifice, with the firing mechanism being located within the nozzle chamber. Each nozzle is supplied with ink from an ink supply reservoir, noting that different nozzles can be supplied with ink from different ink reservoirs for printing multiple colors or for printing on different types of media.

A trend in inkjet printer technology has been to periodically clean (or service) the printhead by wiping the printhead (and particularly the nozzle orifices) with one or more wipers. The wipers typically resemble rubber squeegee devices. Servicing the printhead in such a manner tends to improve print quality and lengthen the useful life of a print cartridge by removing aerosol deposits, excess ink, dust, minute pieces of paper debris and other contaminants from the printhead.

Typically, the wipers are mounted on a servicing sled that is moved with respect to the printhead by a drive assembly. The drive assembly is configured to drive the sled with a predetermined amount of force. In a conventional inkjet printer, this force is set to be large enough to move the sled when taking into account variability in printer components (i.e., differences in printer parts from printer to printer), aging of the printer components and so forth. As a result, the force applied to the servicing sled is often excessive. Excessive force can lead to increased noise production from the printer during printhead servicing. These sounds can include, for example, mechanical "whining" or "straining" (as the sled is intentionally stalled against mechanical stops) and "clacking" caused by the sled hitting the mechanical stops. The increased noise production can be unsettling to a user of the printer. In addition, the excessive force can unduly stress printer components and can lead to premature failure of printer components.

Another characteristic of conventional inkjet printer servicing sled control is that if the sled becomes unintentionally stalled (e.g., stuck under the printhead), all printer operation is ceased. This characteristic can make the printer unreliable and can leave a user of printer without the ability to print even though the printer is otherwise operational to image the desired print job.

Accordingly, there exists a need in the art to enhance the control over the servicing sled of an inkjet printer.

SUMMARY OF THE INVENTION

According to one aspect of the invention, a method of adaptively controlling an amount of force applied to a servicing sled used to clean an inkjet printhead. The method includes: (a) applying a run force associated with a stored force level to the servicing sled; (b) sensing a first unintentional stall of the servicing sled during application of the run force; (c) selecting a lowest test force from a plurality of test forces to be a current test force; (d) applying the current test force to the servicing sled; (e) upwardly incrementing the current test force if a second unintentional stall of the servicing sled is sensed during application of the current test force, otherwise storing an adapted force level indication associated with the current test force in place of the stored force level indication; and (f) repeating operations (d) and (e) if the current test force is less than a highest test force form the plurality of test forces, otherwise storing an adapted force level indication associated with the highest test force in place of the stored force level indication.

According to another aspect of the invention, an inkjet printer. The inkjet printer includes a printhead adapted to progressively deposit ink droplets on a print medium and a servicing sled having a wiper for removing contaminants from the printhead. A drive motor is coupled to the servicing sled with a sled drive linkage to move the servicing sled with respect to the printhead. A sensor is adapted to generate a signal indicative of distance traveled by the servicing sled. A control assembly is adapted to control the drive motor so as to vary mechanical force applied to the servicing sled. The control assembly is programmed to select a run force from a plurality of run forces with which to move the servicing sled during a printhead service by controlling the drive motor to apply a test force from a plurality of test forces to the servicing sled, each test force corresponding to one of the run forces, and by comparing a distance traveled by the servicing sled during application of the test force and a predetermined distance to determine if the test force is sufficient to actuate the servicing sled.

Other features and advantages of the present invention will become apparent to a person with ordinary skill in the art in view of the following drawings and detailed description. It is intended that all such additional features and advantages be included herein within the scope of the present invention.

BRIEF DESCRIPTION OF THE SEVERAL VIEWS OF THE DRAWINGS

The invention can be understood with reference to the following drawings. The components in the drawings are not necessarily to scale. Also, in the drawings, like reference numerals designate corresponding parts throughout the several views.

DETAILED DESCRIPTION OF THE INVENTION

Figure 1:
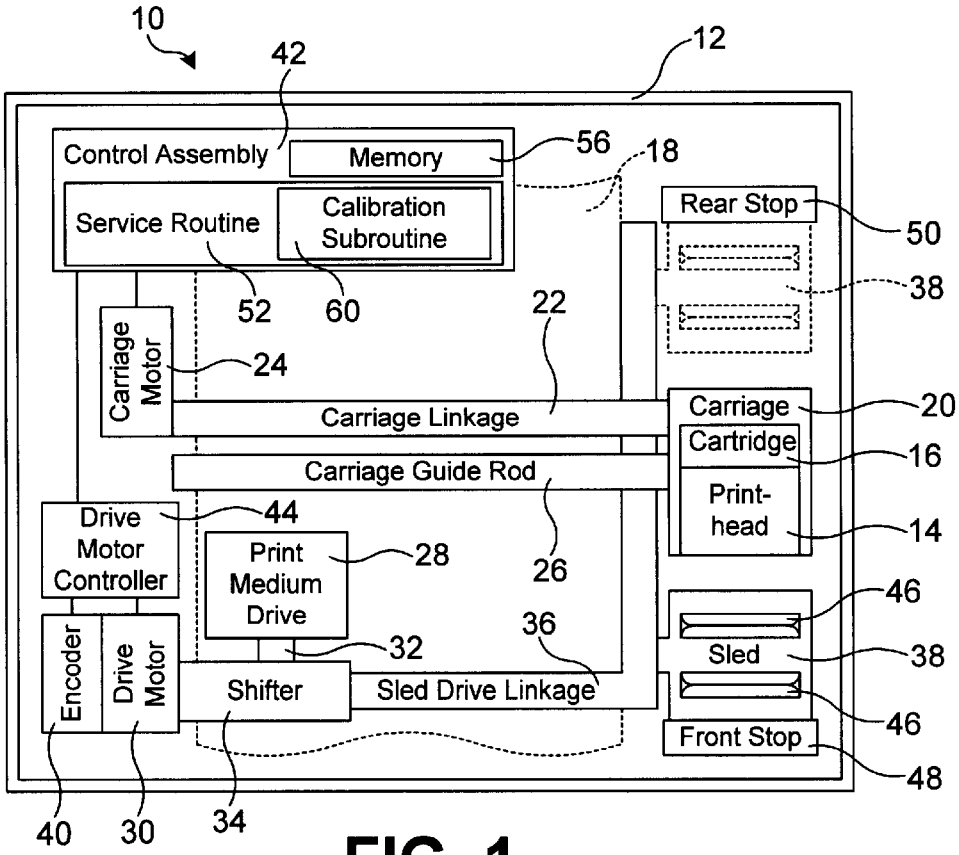
FIG. 1 is a schematic block diagram of a printing apparatus according to the present invention.

Referring initially to FIG. 1, a printer apparatus 10 is illustrated. The illustrated printer apparatus 10 is an inkjet printer adapted to receive a print job from a print job source (not shown). The print job can be in a format compatible with the printer 10, such as a page description language (PDL) file or a page control language (PCL) file.

As one skill in the art will appreciate, the illustrated inkjet printer 10 is exemplary and the present invention applies to inkjet printers having different configurations and other types of printers that print by moving a printhead over a print medium in successive passes such as, for example, a thermal printer, a plotter, and the like.

The print job source (not shown) can be a general computing device such as a desktop or portable computer, a workstation, a personal digital assistant (PDA), a network server (e.g., a print server), or the like. The print job source can be connected directly to the printer 10 or coupled to the printer 10 via a network as is well known in the art.

The printer 10 includes a housing 12 that supports various subcomponents of the printer 10. The printer 10 includes an inkjet printhead 14 mounted on a print cartridge 16. The printhead 14 is used to print or image a desired pattern on a print medium 18 as dictated by the print job. For this purpose, the print cartridge 16 can have one or more ink supply reservoirs. The print cartridge 16 can be removably supported by a carriage 20 that moves the printhead 14 laterally over the print medium 18 as is known in the art. A platen (not shown), having a print medium 18 supporting surface, can be disposed under the print medium opposite the printhead 14.

The carriage 20 can be actuated by a carriage linkage assembly 22 that is driven by a carriage motor 24. As is known in the art, the carriage 20 can be supported and its motion can be guided by a carriage guide rod 26. The carriage 20, the carriage linkage 22, the carriage motor 24 and the carriage guide rod 26 are well known components and will not be described in greater detail herein.

In one embodiment, the printhead 14 has an array of nozzles as is known in the art. The nozzles can be arranged, for example, in a matrix of rows and columns and can be grouped into pens. The nozzles can be controlled to express ink droplets as the printhead 14 moves over the print medium 20 to produce a desired image on the print medium 20. Each nozzle can be formed from a nozzle chamber, a firing mechanism and an orifice, with the firing mechanism being located within the nozzle chamber. As one skill in the art will appreciate, other types of printheads, pens, nozzle assemblies, heater elements, and the like can be used in place of the printhead 14 depending on the specific printer.

As indicated, the printhead 14 is moved laterally over the print medium 18 in successive passes or sweeps. In addition, the print medium 18 can be advanced, usually between sweeps of the printhead 14, in a direction perpendicular to the motion of the printhead 14 so that the printhead 14 can progressively lay down segments (or portions) of the desired pattern being printed. Movement of the printed medium 20 can be carried out by a print medium drive 28, such as a grouping of rollers that engage the print medium 18. The print medium drive 28 can be actuated by a drive motor 30 coupled to the print medium drive 28 by a print medium drive linkage 32.

In one embodiment of the invention, the print medium drive 28 can also be coupled to the drive motor 30 via a shifter 34. The shifter 34 is used to selectively divert power developed by the drive motor 30 from the print medium drive 28 to a sled drive linkage 36. As will be discussed in greater detail below, the sled drive linkage 36 is coupled to actuate a servicing sled 38. Alternatively, the sled drive linkage 36 and/or servicing sled 38 can be driven by a dedicated motor (i.e., a motor not used to drive other assemblies).

To assist the printer 10 in tracking how far the print medium 18 has been advanced, an encoder 40 can be coupled to the drive motor 30 to monitor rotational movement of the drive motor 30. In one embodiment, the encoder 40 can be an optical encoder that generates an output signal indicative of the number of times the optical encoder detects the passing of markings disposed on a rotating disk located in front of the encoder. The markings can be, for example, printed indicia, holes, notches, etc. The encoder 40 can be implemented to generate an electrical pulse each time the drive motor 30 rotates an angular distance equivalent to a predetermined linear distance traveled by the print medium 18 and/or the sled 38. For example, the encoder could generate a pulse corresponding to every $1/2400$ of an inch of linear travel of the print medium 18 and/or the sled 38. The pulses can be summed to give an indication of distance traveled.

Movement of the printhead 14 and deposition of ink from the printhead 14 onto the print medium 18 is controlled by a control assembly 42. The control assembly 42 also controls advancement of the print medium 18 by controlling the drive motor 30 and configuration of the shifter 34. The distance the print medium 18 is advanced can be tracked using a software implemented position counter maintained by the control assembly 42 and incremented using the output signal from the encoder 40.

Similarly, the control assembly 42 controls movement of the servicing sled 38 via the drive motor 30 and configuration of the shifter 34. Distance traveled by the sled 38 can also be tracked with the software implemented position counter.

The control assembly 42 is coupled to the drive motor 30 via a drive motor controller 44. The drive motor controller 44 is adapted to receive control signals from the control assembly 42 and, in accordance with those control signals, supply electrical power to the drive motor 30. The electrical power supplied to the drive motor 30 can be controlled to invoke different rotational speeds of the drive motor 30 and/or different torque outputs from the drive motor 30. In one embodiment, the electrical power supply to the drive motor 30 can be controlled using pulse with width modulation (PWM). The drive motor controller 44 can also receive the signal indicative of rotational movement of the drive motor 30 from the encoder 40 and relay the encoder output signal to the control assembly 42 or communicate a corresponding distance measurement to the control assembly 42. Alternatively, the encoder 40 can be coupled directly to the control assembly 42.

The control assembly 42 can include various components for assisting in the printing a received print job on the print medium 18. Such components can include, for example, a processor, volatile and nonvolatile memory components, buffers, counters and so forth. The control assembly 42 can execute various logical routines in conjunction with imaging the print job on the print medium. Such routines can include, for example, a communication interface routine to carry on data communications with the print job source, a shingling routine to process print data, control routines to control the movement of the carriage 20, the expression of ink droplets from the printhead 14, the movement of the print medium 20, and so forth. In addition, the printer 10 can be provided with additional subassemblies for assisting in printing on the print medium 18 and can include, for example, rollers, motors, mechanical actuators, power supplies, and so forth.

As should be appreciated by one of ordinary skill in the art, the printhead 14 can collect undesirable foreign matter and/or contaminants thereon. Such matter can include, for example, aerosol deposits, excess ink, dust, minute pieces of paper debris, and other contaminants. Excessive build up of foreign matter on the printhead 14 can adversely affect the overall print quality of the pattern imaged on the print medium 18 and can also lead to clogged nozzles and ink smudges.

Accordingly, the printer 10 can be provided with the servicing sled 38. The servicing sled 38 has one or more wipers 46 mounted thereon. The wiper(s) 46, which can resemble a rubber squeegee(s), are moved by the sled 38 under the mechanical power provided by the drive motor 38 via the shifter 34 and the sled linkage 36. The sled 38 is actuated to engage the wiper(s) 46 against the printhead 14 and to wipe contaminants therefrom. More specifically, the carriage 20 is moved to and held at a specified location corresponding to the path of the sled 38. In addition, the shifter 34 is controlled to divert power developed by the drive motor 30 from the print medium drive 28 to the sled drive linkage 36. Under the power provided by the drive motor 30, the sled 38 is then actuated to travel from a home position adjacent a first, or front, stop 48 towards an intentional stall position against a second, or rear, stop 50. In the exemplary illustration of FIG. 1, the sled 38 is illustrated in solid lines in the home position and is illustrated again in dashed lines in the intentional stall position. As will be discussed in greater detail below, it is noted that the home position and/or the intentional stall position need not be adjacent or against a mechanical stop device.

When the sled 38 engages the front stop 48 or the rear stop 50 the sled 38 will stop moving. By virtue of the mechanical connections within the printer 10, the sled linkage 36, parts of the shifter 34, and the drive motor 30 will also stop their movements when the sled stalls against the stop 48 or 50. As a result, the encoder 40 will no longer detect movement of the drive motor 30. By processing the signal produced by the encoder 40, the distance the sled 38 has traveled from the home position to the stall position, and vice-versa, can be determined. It is noted that there may be a delay between the time when the sled 38 stops moving and when the stall is detected by the control assembly 42 and the drive motor 30 is turned off.

Once the sled 38 has stalled against the rear stop 50, the movement of the sled 38 can be reversed by appropriate energizing of the drive motor 30 or by appropriate mechanical setting in the shifter 38 and/or the sled linkage 36. The sled 38 then moves from the stall position to the home position (i.e., adjacent the front stop 48) where the motion of the sled 38 is stopped by contact with the front stop 48.

During the movement of the sled 38 from the home position to the stall position (or, as used herein, a rearward motion of the sled 38) and during movement of the sled 38 from the stall position to the home position (or, as used herein, a frontward motion of the sled 38) the wipers 46 engage the printhead 14 to remove contaminants therefrom.

In another embodiment, the sled 38 is not stalled against the rear stop 50 to terminate the rearward motion and/or the sled 38 is not stalled against the front stop 48 to terminate forward motion. Rather, distance traveled by the sled 38 is used to determine when the sled 38 has been moved to the intentional stall position (which need not be adjacent or against a stop device) and/or to the home position (which need not be adjacent or against a stop device). Upon reaching such a position, the drive motor 30 can be commanded (e.g., deactivated) to end movement of the sled 38 (this commanded stopping of the sled 38 falling within the meaning of the term intentional stall as used herein). However, in this alternative embodiment, the sled 38 can be "tapped" against the front stop 48 and stalled by mechanical inhibition of motion before commencing reward rearward motion to set a known (or "absolute") sled 38 position for use in distance measurement. Also, regardless of whether the sled 38 is stalled against stops 48, 50 or stalled by command, the sled 38 can be left near, but not touching, the front stop 48 when the printer 10 is performing other functions.

A certain amount of mechanical force needs to be exerted on the sled 38 in order to move the sled 38. The amount of force needed to move the sled 38, especially when the wipers 46 are engaged against the printhead 14, will depend on a number of variables. These variables can differ from printer to printer, including printers of the same type. The variables can include electrical variables and mechanical variables. Electrical variables can include the output of an electrical power supply (not shown) used to provide electrical power the various components of the printer 10 (e.g., the power supply may output a voltage that is more or less than a nominal specification value). Other electrical variables can include, for example, variances in drive motor 30 efficiency and variances in the drive motor controller 44 (e.g., the drive motor controller 44 can be used to generate a power input (voltage and current) to the drive motor 30 in response to a control signal received from the control assembly 42).

Mechanical variables can include, for example, tolerances associated with bearings, shafts, spring-loaded controllers found in shifter 34 and the sled linkage 36. Each of these components have variability and also wear over time. Such wear can lead to stiffening of the power train from the drive motor 30 to the sled 38.

Another mechanical variable includes the stiffness of the wiper(s) 46. Typically, the wiper(s) 46 will deflect backwards (e.g., away from the direction of travel of the sled 38) as the wiper 46 engages the printhead 14. Within normal manufacturing tolerances, the stiffness of the wiper(s) 46 may vary from printer to printer. Also, over time, the stiffness of the wipers 46 may increasingly need more force to be moved with respect to the printhead 14. It is noted that in the illustrated embodiment, the front stop 48 and the rear stop 50 are positioned such that the sled 38 travels a sufficient distance so that the wipers 46 disengage from the printhead 14 following a full rearward pass of the sled 38 and frontward pass of the sled 38.

Accordingly, the printer 10 is provided with a service routine 52 to govern the movement of the sled 38. The service routine 52 includes an adaptive calibration routine (discussed in greater detail below) for adjusting the output power of the drive motor 30 when the drive motor 30 is used to actuate the sled 38. Hence, the amount of mechanical force applied to the sled 38 can be varied. The service routine can be stored and executed by the control assembly 42. In one embodiment, the service routine 52 can be implemented in firmware, or as a set of logic instructions in the form of computer code for execution by a general purpose processor.

The service routine 52 is implemented to adaptively control the force used to move the sled 38, accounting for to the electrical and mechanical variables of the specific printer 10. As a result, the use of excessive force to move the sled 38 can be minimized. By minimizing the use of excessive force, stress placed on components of the printer 10 can be reduced. Reducing stress may result in increasing the useful life of the printer components and/or the printer 10 as a whole.

In addition, reducing the use of excessive force can result in lowering noise output from the printer 10. For example, a "clacking" sound made by the sled 38 hitting against the front stop 48 and/or the rear stop 50 may be lower in volume for the printer 10 having the adaptive sled 38 control techniques described herein than for a printer using a single predetermined force to move the sled 38. Another sound that may be lowered in volume by the adaptive control techniques described herein can include a "whining" or "straining" sound produced by the drive motor 30 and/or other moving mechanical components when the sled 38 is intentionally stalled against either of the front stop 48 or the rear stop 50.

It is noted that the service routine 52 can be commenced by the control assembly 42 at any appropriate time, such as before the commencement of printing a print job, after the completion of the printing the print job, and/or according to a pen maintenance schedule (e.g., after the printing of every five pages). In some embodiments, where the shifter 34 disengages the print medium drive linkage 32 when the sled drive linkage 36 is engaged, the service routine 52 could be commenced in the middle of printing a page.

Figure 2:
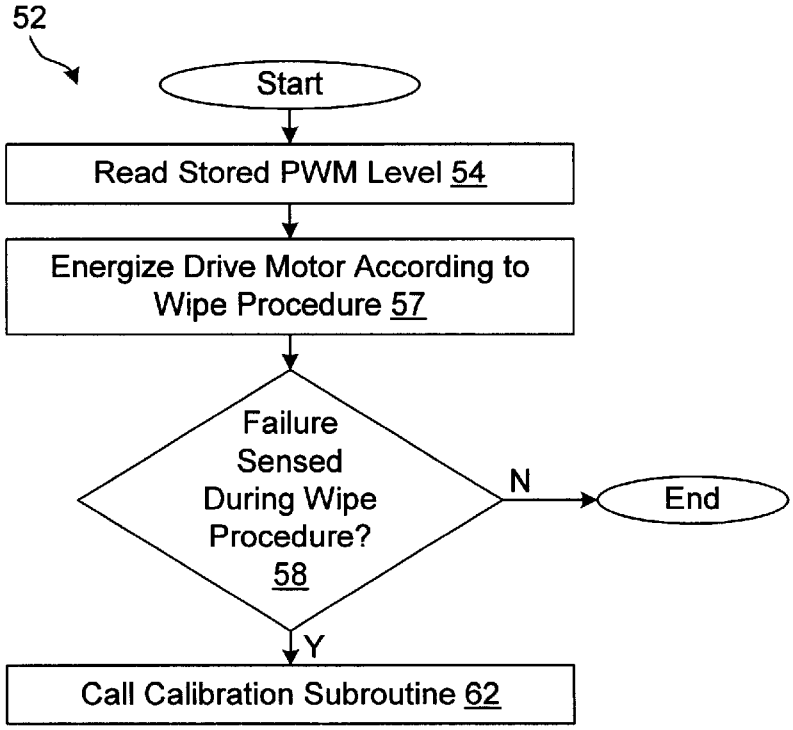
FIG. 2 is a flow chart of a service routine carried out by the printing apparatus of FIG. 1.

With additional reference to FIG. 2, the service routine 52 will be described in greater detail. Briefly, FIG. 2 is an exemplary flowchart of the service routine 52 according to the present invention. Alternatively, the flowchart of FIG. 2 can be thought of as depicting steps in a method implemented by the printer 10.

The service routine 52 can begin in box 54 where a stored variable relating to a desired power output level from the drive motor 30 can be retrieved from a memory component 56. As should be appreciated, the power output level is directly related to force applied to the sled 38. The memory component 56 can be a nonvolatile memory capable of storing data values in the absence of electrical power. As illustrated, the memory component 56 can be part of the control assembly 42 or, alternatively, can be implemented independently of the control assembly 42.

In one embodiment, the stored variable relating to desired power output of the drive motor 30 can be in the form of a PWM level. As indicated above, the power output of the drive motor 30 can be controlled by supplying pulse width modulated electrical power to the drive motor 30. Accordingly, the drive motor controller 44 can include circuitry for converting a control signal received from the control assembly 42 to a corresponding electrical output.

Table 1 contains example PWM values (expressed as percentages) for multiple example PWM levels that can be stored by the memory 56. It is noted that the use of PWM and of the PWM levels and PWM values described herein relates to just one embodiment of adaptively controlling the drive motor 30 to result in the exertion of varying degrees of force on the sled 38. Other force varying techniques can be employed and can include other drive motor 30 power input regulation and/or mechanical power control (e.g., a transmission). Also, the PWM levels and PWM values directly correspond with the force applied to the servicing sled 38 and can be thought of as indicators of force levels and/or force values. The PWM levels and PWM values described herein can be stored as actual percentage values in a logical look-up table, can be stored as control signal values in digital. or analog format or as any other data value or signal indicative of force to be applied to the sled 38.

TABLE 1

| | Run PWM Value | Stall PWM Value | Test PWM Value |
|---|---|---|---|
| PWM Level 1 | 27% | 19% | 25% |
| PWM Level 2 | 32% | 23% | 30% |
| PWM Level 3 | 37% | 27% | 37% |

As indicated in Table 1, three PWM values can be associated with each PWM level, including a run PWM value, a stall PWM value, and a test PWM value. Since the PWM values correspond with mechanical force applied to the sled 38, the run PWM values can also be thought of as indicators of run force, stall force and test force.

As will be described in greater detail below, the run PWM value can be used when actuating the sled 38 to engage the wipers 46 against the printhead 14 for cleaning of the printhead 14. The stall PWM value is used in preparation for intentionally stalling the sled 38 against either of the front stop 48 or the rear stop 50. The stall PWM values are lower than the corresponding run PWM values so as to reduce the force used to actuate the sled 38 as the sled 38 engages either of the stops 48 or 50. Reducing the force used to actuate the sled 38 before engagement with the stops 48 and 50 can reduce the mechanical stress placed on the sled's drive system and can reduce noise output from the printer 10. In the example of Table 1, the run PWM values are incremented from PWM level to PWM level by five percent and the stall PWM values are incremented from PWM level to PWM level by four percent.

The test PWM values, as will be described in greater below, are values used in conjunction with moving the sled 38 during a calibration subroutine of the servicing routine 52. For reasons discussed in greater detail below, the test PWM values can be set to be less than the corresponding run PWM values. In one embodiment, the test PWM value for the highest PWM level can be set to be the same as the corresponding run PWM value.

The service routine 52 can continue in box 57 where the sled 38 is actuated to service the printhead 14 by energizing the drive motor 30 in accordance with a predetermined printhead service procedure. The printhead service procedure can begin by tapping the front stop 48 with the sled 38 and using the stall PWM value associated with the PWM level retrieved in box 54 for confirmation that the sled 38 is in the home position. Thereafter, the sled 38 can be moved towards the rear stop 50 such that the wipers 46 engage the printhead 14. As the sled 38 is moved towards the rear stop 50 in a rearward direction, the drive motor 30 can be energized with electrical power corresponding to the run PWM value of the PWM level retrieved from memory in box 54. As a default, the retrieved PWM level can be the lowest PWM level (i.e., the PWM level having the lowest associated PWM values). As will be described in greater detail below, the PWM level stored by the memory 56 and retrieved in box 54 can be altered by the calibration subroutine discussed below.

After the output signal generated by the encoder 40 indicates that the sled 38 has moved the wiper past the printhead 14, the force applied to the sled 38 can be reduced by delivering power according to the stall PWM value associated with the PWM level retrieved from the memory 56 in box 54. In this manner, the service routine 52 predicts when the sled 38 is about to engage the rear stop 50 and reduces the force used to actuate the sled 38. After the sled 38 is intentionally stalled against the rear stop 50, the movement of the sled 38 can be reversed such that the sled 38 is moved in the forward direction from the stall position to the front stop 48 with the run PWM value associated with the PWM level retrieved from the memory 56 in step 54. When the sled 38 is nearing the front stop 48, the drive motor 30 can be controlled with the stall PWM value associated with the PWM level retrieved from the memory 56 in box 54 to reduce the amount of force with which the sled 38 engages the front stop 48. After the sled 38 is intentionally stalled against the front stop 48, the drive motor 30 can be de-energized.

As the wipe procedure of box 56 is being carried out, the service routine 52 can monitor for a failure of the wipe procedure in box 58. As used herein, a failure of the wipe procedure relates to an unintentional stall of the sled 38. An unintentional stall of the sled 38 can include inability of the sled 38 to move from either the home position or the stall position, or can include a stopping of the sled 38 in a position between the home position and the stall position. One main cause of such a failure of the sled 38 to complete the wipe procedure is inadequate application of force to the sled 38. In one embodiment, failure of the wipe procedure is sensed by monitoring the distance that the sled 38 travels using the signal output by the encoder 40 and comparing the distance of sled 38 travel against a known, or predetermined, distance that the sled 38 should travel from one stop 48 or 50 to the other stop 48 or 50. In one embodiment, distance of sled 38 travel is calculated by comparing a beginning position counter value with an ending position counter value. If the distance traveled from the beginning of a movement of the sled (e.g., a rearward movement starting at the home position or a forward movement starting at the stall position) to the end of the sled 38 movement (i.e., the sensing of a stall condition, for example, where the encoder no longer generates output pulses) does not indicate a traveled distance corresponding to the known distance within a given tolerance (e.g., about ⅛ of an inch) a failure can be presumed. If a failure is not detected in box 58, the service routine 52 can end and the printer 10 can be placed in an operational state to carry out other printer 10 functions, such as, capping the printhead 14, continuing to image the print job on the print medium 18, or waiting for the next print job to be received.

If a failure is detected during the wipe procedure in box 58, the service routine 52 can call an adaptive calibration subroutine 60 in box 62. In one embodiment, if the PWM level retrieved in box 54 is the highest PWM level, then the service routine 52 can end, even if a failure is sensed in box 58.

Figure 3:
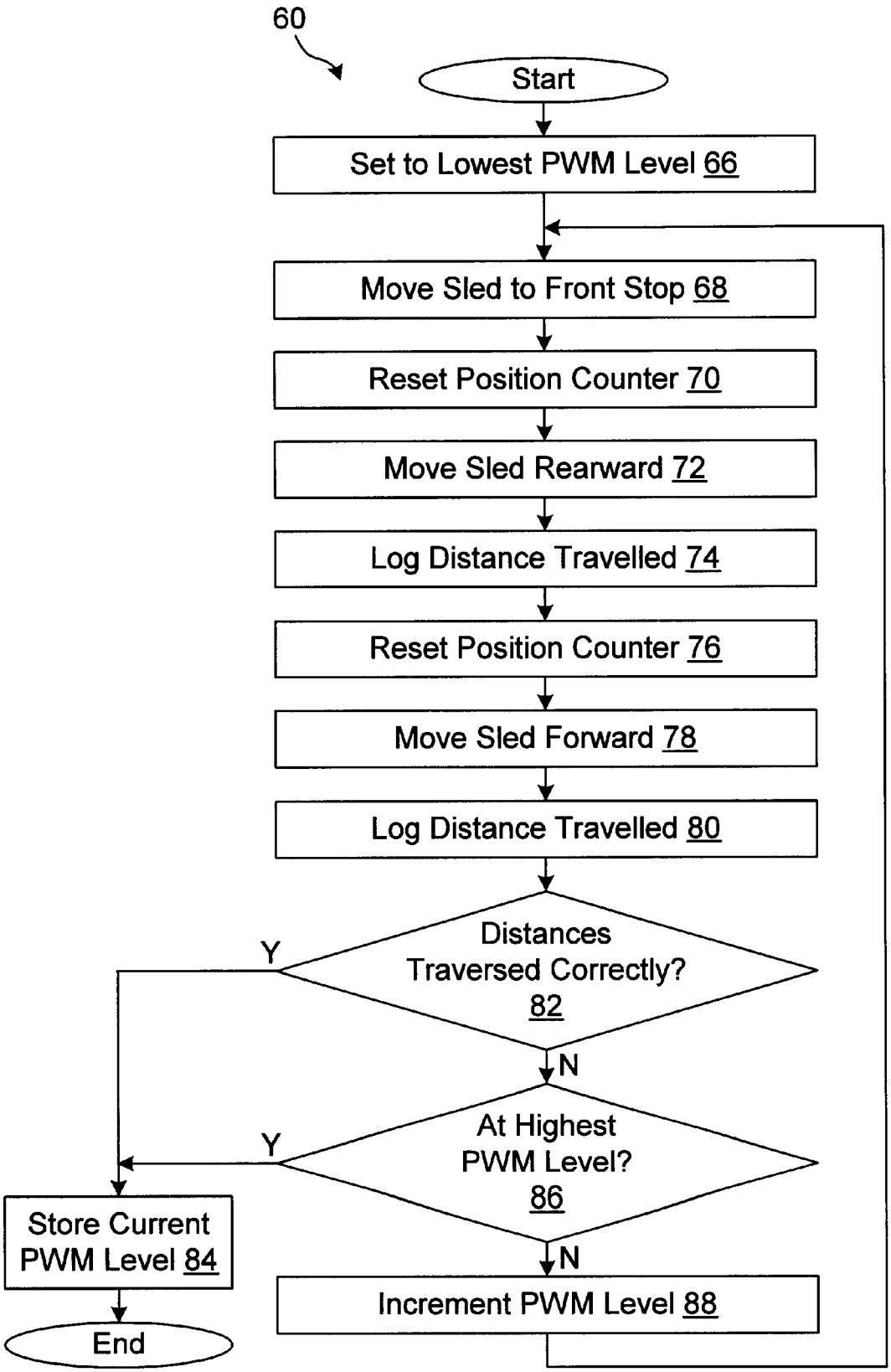
FIG. 3 is a flow chart of a calibration subroutine of the service routine of FIG. 2 and carried out by the printing apparatus of FIG. 1.

With additional reference to FIG. 3, shown is an exemplary flowchart of the calibration subroutine 60 according to the present invention. Alternatively, the flowchart of FIG. 3 can be thought of as depicting steps in a method implemented by the printer 10.

It is noted that the actual location of the sled 38 may be unknown at this point in the service routine 52/calibration subroutine 60. The sled 38 could be in the home position, in the stall position or at some location therebetween, such as stalled under the print head 14. In addition, the calibration subroutine 60 can be implemented to not be concerned as to whether the sled 38 was unintentionally stalled while traveling in the rearward direction or in the forward direction.

The calibration subroutine 60 can start in box 66 where the calibration subroutine 60 can set the PWM level to be initially used by the calibration subroutine 60 to the lowest PWM level. Setting the currently used PWM level to the lowest level allows for the calibration subroutine 60 to test the amount of force needed to move the sled 38 starting from a low level and progressing to higher levels, if needed, so that the use of excessive force can be minimized. There may be some circumstances where a higher PWM level was stored for retrieval and use by the service routine 52 in box 54, but the condition that caused the use of a higher PWM level no longer exists. In one example, a portion of the print medium 18 could have become lodged in the path of the sled 38 and the presence of the piece of print medium 18 caused the sled 38 to unintentionally stall. This unintentional stall would cause the service routine 52 to enter the calibration subroutine 60 where it is possible that the PWM level was set to a level higher than the lowest PWM level. At some time after the occurrence of these events, the portion of the print medium 18 that gave rise to the events may have been removed from the printer 10 and the need for using a relatively high PWM level may no longer exist.

In one embodiment of the calibration subroutine 60, the run and stall PWM values are not used during the calibration subroutine 60 and the drive motor 30 is supplied with power corresponding to the test PWM values.

The calibration subroutine 60 can continue in box 68 where the drive motor controller 44 can be supplied with a control signal to energize the drive motor 30 to move the sled 38 in a forward direction. This movement attempts to move the sled 38 to the home position against the front stop 48. During the "homing" of the sled 38 during the first pass through the calibration subroutine 60, the drive motor 30 is energized using the test PWM that corresponds to the lowest PWM level. In the example of Table 1, this PWM value is twenty five percent. In box 68, the sled 38 is moved forward until a stall is sensed. The stall can be sensed as described above (i.e., no movement of the drive motor 30 as detected by the encoder 40). Therefore, is noted that the test PWM value associated with the lowest PWM level may not be sufficient to move the sled 38 at all, may not be sufficient to move the sled 38 all the way to the front stop 48, or is sufficient to move the sled 38 to the front stop 48.

Thereafter, in box 70, the position counter is reset so that subsequent distance traveled by the sled 38 can be determined by reference to the position counter. Thereafter, in box 72, the calibration subroutine 60 can invoke commands to energize the drive motor 30 to move the sled 38 in the rearward direction using the test PWM associated with the current PWM level (e.g., in the first pass through the calibration subroutine 60, the PWM level being set to the lowest PWM level).

In box 72, the sled 38 is moved in the rearward direction until a stall is sensed. This stall may have occurred as a result of the sled 38 engaging the rear stop 50 or that inadequate force was applied to the sled 38 to move the sled 38 to the stall position against the rear stop 50. In either event, the distance traveled by the sled 38 during the rearward movement of the sled 38 in box 72, if any, is logged in box 74.

The calibration subroutine 60 can continue in box 76 where the position counter is reset to assist in tracking subsequent movement of the sled 38. Next, in box 78, the sled 38 can be moved in the forward direction by energizing the drive motor 30 with the test PWM value associated with the current PWM level. The sled 38 is actuated until a stall is sensed. The stall can be the result of the sled 38 moving to the home position and stalling against the front stop 48 or the result of using inadequate force to attempt to actuate the sled 38. In either case, the calibration subroutine 60 logs the distance traveled in the forward direction, if any, in box 80.

In one embodiment, the calibration subroutine 60 can be implemented to switch from using the test PWM value to the associated stall PWM when it is anticipated that the sled 38 will reach one of the stall position or the home position (e.g., after it has been sensed that the sled 38 has moved a distance slightly less than the full distance between the front stop 48 and rear stop 50).

The calibration subroutine 60 can then determine, in box 82, if the rearward movement in box 72 and forward movement in box 78 resulted in full traversals of the sled 38 moving from the home position to the stall position and back to the home position. In one embodiment, the distances logged in box 74 and box 80 are compared against a known, or predetermined, distance of travel from the home position to the stall position within a given tolerance (e.g., about ⅛ of an inch). If the distances were traversed correctly, the calibration subroutine 60 can proceed to box 84 where the currently used PWM level is stored in the memory 56 for subsequent retrieval by the service routine 52 (e.g., in box 54 of FIG. 2) the next time the service routine 52 is called by the printer 10. Thereafter the calibration subroutine 60 can end and the printer 10 can be returned to another state, such as waiting for a new print job, continuing to image a present print job, capping the printhead 14, etc.

If the distances were not traversed correctly in box 86, the calibration subroutine 60 can proceed to box 84 where the calibration subroutine 60 can determine if the currently used PWM level is the highest available PWM level. If the calibration subroutine 60 is currently using the highest available PWM level, the calibration subroutine 60 can proceed to box 84 where the highest available PWM level is stored in the memory 56 and the calibration subroutine 60 can end.

It is noted that the highest available PWM level is often sufficient to provide enough force to move the sled 38 to the home position. In one embodiment, the test PWM value associated with the highest PWM level is the same as the run PWM value for the highest PWM level. This allows for a high level of available force to be applied to the sled 38 to make an attempt to home the sled 38 at completion of the calibration subroutine 60. Without intending to be bound by theory, the use of such force during the final pass through the calibration subroutine 60 may place the printer in condition for carrying out printing tasks, even if the service routine 52 cannot be successfully completed (i.e., no unintentional stall of the sled 38).

In one example modification to the calibration subroutine 60, a box can be added between box 86 and box 84 to move the carriage 20 out of the path of the sled 38 and to again attempt to move the sled 38 to the home position. These additional steps can be completed for printers 10 where there may be a concern that a sled 38 that is stalled under the carriage 20 may interfere with the carriage 20 as the carriage makes successive passes over the print medium 18.

If, in box 86, the calibration subroutine 60 is not operating using the highest available PWM level, the calibration subroutine 60 can proceed to box 88 where the PWM level is incremented from the currently used PWM level to a next higher PWM level. In the example, after a first pass through the calibration subroutine 60, the PWM level may be incremented from the first PWM level in box 88 to the second PWM level. Thereafter, the calibration subroutine 60 returns to box 68 where the foregoing process is repeated until one of the conditions in box 82 or box 86 is satisfied. After a second pass through the calibration subroutine 60 where the conditions in box 82 or box 86 are not satisfied, the PWM level can be incremented from the second level to the third level in box 88. In this example, the next pass through the calibration subroutine 60 will be the last pass through the calibration subroutine 60 since at least the condition of box 86 will be satisfied. However, it is noted that the use of three PWM levels is exemplary and a smaller or larger number of PWM levels can be established as is desired.

While executing the calibration subroutine 60, the power supplied to the drive motor 30 can be selected from the test PWM value associated with the current PWM level. In the embodiment described herein, the test PWM value is about two percent less than the run PWM value for each PWM level, except for the highest PWM level. This arrangement allows for testing the appropriate force that should be applied to the sled 38 at a slightly lower value than is used for normal operation during the service routine 52. This arrangement provides for some tolerance in calibrating the appropriate force that should be applied to the sled 38. For example, if the calibration subroutine 60 could successfully actuate the sled 38 using a PWM value of 32% but the sled could not be moved at 31.8% or may later become immovable at 32.2%, then testing at 32% may prove undesirable. Therefore, the calibration subroutine 60 evaluates movement of the sled 38 with some margin to account for slight differences in operational efficiency among multiple executions of the service routine 52.

As should be apparent to one skilled in the art, the calibration subroutine 60 provides a self-healing function to the service routine 52. The calibration subroutine 60 is implemented to adaptively find an appropriate force to be applied to the sled 38 to minimize use of excessive force that can otherwise result in premature wear of components and the production of excess noise. In addition, the calibration subroutine 60 operates without a direct force feedback indication (rather, a measurement of distance traveled is used). However, the calibration subroutine 60 and/or the service routine 52 can be modified to use a signal indicative of force applied to the sled 38 (e.g., a torque measurement derived from monitoring current drawn by the drive motor 30). In other embodiments, additional sensors and feedback devices can be added and used in conjunction with the service routine 52 and/or the calibration subroutine. For example, pressure sensors located at the front stop 48 and the rear stop 50 to indicate when the sled 38 has move respectively to the home position and the stall position could be added. One skilled in the art will appreciate that sensors other than or in addition to the encoder 40 can be used to measure distance traveled by the sled 38.

The figures show the architecture, functionality, and operation of an implementation of the service routine 52 and the calibration subroutine 60. If embodied in software, each illustrated block may represent a module, segment, or portion of code that comprises program instructions to implement the specified logical function(s). The program instructions may be embodied in the form of source code that comprises human readable statements written in a programming language or machine code that comprises numerical instructions recognizable by a suitable execution system such as a processor in a computer system or other system. The machine code may be converted from the source code. If embodied in hardware, each block may represent a circuit or a number of interconnected circuits to implement the specified logical function(s).

Although the service routine 52 and the calibration subroutine 60 illustrate specific orders of execution, it is understood that the order of execution may differ from that which is depicted. For example, the order of execution of two or more blocks may be changed relative to the order shown. Also, two or more blocks shown in succession may be executed concurrently or with partial concurrence. In addition, some blocks may be omitted and other functionality can be added. Any number of counters, state variables, warning semaphores, or messages might be added to the logical flow described herein, for purposes of enhanced utility, accounting, performance measurement, or providing troubleshooting aids, and the like. It is understood that all such variations are within the scope of the present invention.

Also, where the service routine 52 and the calibration subroutine 60 comprise software or code, the service routine 52 and/or the calibration subroutine 60 can be embodied in any computer readable medium for use by or in connection with an instruction execution system such as, for example, a processor in a computer system or other system. In this regard, the logic may comprise, for example, statements including instructions or declarations that can be fetched from the computer-readable medium and executed by the instruction logic system. In the context of the present invention, a "computer-readable medium" can be any medium that can contain, store or maintain the logic described herein for use by or in connection with the instruction execution system. A computer-readable medium can comprise any one of many physical media such as, for example, electronic, magnetic, optical, electromagnetic, or semiconductor media. More specific examples of suitable computer-readable medium will include, but are not limited to, magnetic tapes, magnetic floppy diskettes, magnetic hard drives, or compact disks. Also, the computer-readable medium can be random access memory (RAM) including, for example, static random access memory (SRAM), and dynamic random access memory (DRAM), or magnetic random access memory (MRAM). In addition, the computer-readable medium can be a read-only memory (ROM), a programmable read-only memory (PROM), an erasable programmable read-only memory (EPROM), an electronically erasable programmable read-only memory (EEPROM), or other type of memory device.

Although particular embodiments of the invention have been described in detail, it is understood that the invention is not limited correspondingly in scope, but includes all changes, modifications and equivalents coming within the spirit and terms of the claims appended hereto.

What is claimed is:

1. A method of adaptively controlling an amount of force applied to a servicing sled used to clean an inkjet printhead, comprising:

(a) applying a run force associated with a stored force level to the servicing sled;

(b) sensing a first unintentional stall of the servicing sled during application of the run force;

(c) selecting a lowest test force from a plurality of test forces to be a current test force;

(d) applying the current test force to the servicing sled;

(e) upwardly incrementing the current test force if a second unintentional stall of the servicing sled is sensed during application of the current test force, otherwise storing an adapted force level indication associated with the current test force in place of the stored force level indication; and (f) repeating operations (d) and (e) if the current test force is less than a highest test force form the plurality of test forces, otherwise storing an adapted force level indication associated with the highest test force in place of the stored force level indication.

2. The method of claim 1, wherein operation (a) includes attempting to move the servicing sled from a home position adjacent a first stop to an intentional stall position adjacent a second stop such that a wiper mounted on the servicing sled engages the printhead and discontinuing the application of the applied force upon sensing that the servicing sled has stopped moving.

3. The method of claim 2, wherein operation (b) includes comparing a distance actually traveled by the servicing sled with a predetermined distance, the first unintentional stall being sensed if the actually traveled distance is less than the predetermined distance.

4. The method of claim 2, wherein operation (a) further includes reducing the amount of force applied to the servicing sled in expectation of the servicing sled arriving at the intentional stall position.

5. The method of claim 1, wherein the run force and the test forces are produced by a drive motor controlled by pulse width modulation.

6. The method of claim 1, wherein each test force corresponds to an associated run force and each test force is smaller than the corresponding run force.

7. The method of claim 1, wherein each test force corresponds to an associated run force and each test force is smaller than the corresponding run force except for a highest test force of the plurality of test forces, the highest test force being the same as the corresponding run force.

8. The method of claim 1, wherein operation (d) includes a first move attempt to move the servicing sled to a home position adjacent a first stop and a second move attempt to move the servicing sled from the home position to an intentional stall position adjacent a second stop such that during the second move attempt a wiper mounted on the servicing sled engages the printhead.

9. The method of claim 8, wherein operation (e) includes comparing a distance actually traveled by the servicing sled during the second move attempt with a predetermined distance, the second unintentional stall being sensed if the actually traveled distance is less than the predetermined distance.

10. The method of claim 8, wherein operation (d) further includes a third move attempt to move the servicing sled from the intentional stall position to the home position such that during the third move attempt the wiper engages the printhead.

11. The method of claim 10, wherein operation (e) includes comparing a distance actually traveled by the servicing sled during the second move attempt with a predetermined distance and comparing a distance actually traveled by the servicing sled during the third move attempt with the predetermined distance, the second unintentional stall being sensed if either actually traveled distance is less than the predetermined distance.

12. An inkjet printer, comprising:

a printhead adapted to progressively deposit ink droplets on a print medium;

a servicing sled having a wiper for removing contaminants from the printhead;

a drive motor coupled to the servicing sled with a sled drive linkage to move the servicing sled with respect to the printhead;

a sensor adapted to generate a signal indicative of distance traveled by the servicing sled; and a control assembly adapted to control the drive motor so as to vary mechanical force applied to the servicing sled, the control assembly programmed to select a run force from a plurality of run forces with which to move the servicing sled during a printhead service by controlling the drive motor to apply a test force from a plurality of test forces to the servicing sled, each test force corresponding to one of the run forces, and by comparing a distance traveled by the servicing sled during application of the test force and a predetermined distance to determine if the test force is sufficient to actuate the servicing sled.

13. The printer of claim 12, wherein during selection of the run force, the control assembly executes code to:

(a) select a lowest test force from the plurality of test forces to be a current test force;

(b) apply the current test force to the servicing sled; and (c) upwardly increment the current test force if an unintentional stall of the servicing sled is sensed during application of the current test force, otherwise setting the run force corresponding to the current test force as the selected run force; and (d) repeat operations (b) and (c) if the current test force is less than a highest test force form the plurality of test forces, otherwise setting the run force corresponding to the highest test force as the selected run force.

14. The printer of claim 12, further comprising a memory for storing the selected run force level.

15. The printer of claim 12, wherein selection of the run force level is made following detection an unintentional stall during the printhead service.

16. The printer of claim 15, wherein during the print head service the control assembly executes code to attempt to move the servicing sled from a home position adjacent a first stop to an intentional stall position adjacent a second stop and to discontinue the application of force upon sensing that the servicing sled has stopped moving.

17. The printer of claim 16, wherein detection of the unintentional stall includes comparing a distance actually traveled by the servicing sled during the move attempt with a predetermined distance, the unintentional stall being sensed if the actually traveled distance is less than the predetermined distance.

18. The printer of claim 16, wherein during the printhead service the control assembly executes code to reduce the amount of mechanical force applied to the servicing sled in expectation of the servicing sled arriving at the intentional stall position.

19. The printer of claim 12, further comprising a drive motor controller for supplying pulse width modulated electrical power to the drive motor in accordance with a control output signal from the control assembly.

20. The printer of claim 12, wherein each test force is smaller than the corresponding run force.

21. The printer of claim 12, wherein each test force is smaller than the corresponding run force except for a highest test force of the plurality of test forces, the highest test force being the same as the corresponding run force.

22. The printer of claim 12, wherein during the actuation of the servicing sled with the test force, the control assembly is programmed to attempt a first move of the servicing sled to move the servicing sled to a home position adjacent a first stop and to attempt a second move of the servicing sled to move the servicing sled from the home position to an intentional stall position adjacent a second stop.

23. The printer of claim 22, wherein the distance actually traveled by the servicing sled during the second move attempt is the distance compared with the predetermined distance, the test force being sufficient if the actually traveled distance is as great as the predetermined distance.

24. The printer of claim 22, during the actuation of the servicing sled with the test force, the control assembly is programmed to attempt a third move of the servicing sled to move the servicing sled from the intentional stall position to the home position.

25. The printer of claim 24, wherein the controller is programmed to compare a distance actually traveled by the servicing sled during the second move attempt with the predetermined distance and to compare a distance actually traveled by the servicing sled during the third move attempt with the predetermined distance, the test force being sufficient if both actually traveled distances are as great as the predetermined distance.

* * * * *